United States Patent [19]

Grove

[11] Patent Number: 4,787,774

[45] Date of Patent: Nov. 29, 1988

[54] FLUID CONTROL APPARATUS

[76] Inventor: William M. Grove, 1701 Minot Ave., Auburn, Me. 04210

[21] Appl. No.: 68,418

[22] Filed: Jul. 1, 1987

[51] Int. Cl.[4] ..... E02B 7/44

[52] U.S. Cl. ..... 405/94; 405/101; 405/115

[58] Field of Search ..... 405/91, 94, 115, 87, 405/92, 100, 101

[56] References Cited

U.S. PATENT DOCUMENTS

| | | | |
|---|---|---|---|
| 1,084,454 | 1/1914 | Liljegran | 405/94 |
| 1,438,913 | 12/1922 | Grillich | 405/94 |
| 2,118,535 | 5/1938 | Betts | 405/94 |
| 2,609,666 | 9/1952 | Mesnager | 405/115 |
| 2,966,777 | 1/1961 | De Brito Filho | 405/94 |
| 3,173,269 | 3/1965 | Imbertson | 405/87 |
| 4,073,147 | 2/1978 | Nomura | 405/94 |
| 4,136,995 | 1/1979 | Fish | 405/115 |
| 4,252,461 | 2/1981 | Colamussi et al. | 405/115 |
| 4,310,262 | 1/1982 | Calza et al. | 405/87 |
| 4,321,774 | 3/1982 | Fish | 52/63 |
| 4,377,352 | 3/1983 | Goodstein | 405/115 |
| 4,455,106 | 6/1984 | Johnson | 405/94 |

FOREIGN PATENT DOCUMENTS 887706 7/1981 U.S.S.R. .

*Primary Examiner*—David H. Corbin

*Attorney, Agent, or Firm*—Finnegan, Henderson, Farabow, Garrett & Dunner

[57] ABSTRACT

A flexible membrane supported on a series of compound leaf springs is mounded on the fixed crest of a dam or waterway to retain fluid at or below a predetermined maximum level. The apparatus is adapted to automatically release fluid which rises above this predetermined maximum level in response to the increase in fluid pressure exerted upon the flexible membrane and compound leaf springs, and to return to its original fluid-retaining position when the fluid pressure has receded.

11 Claims, 3 Drawing Sheets

FLUID CONTROL APPARATUS

BACKGROUND OF THE INVENTION

The invention relates to a fluid control apparatus for mounting on the fixed crest of a dam or waterway. More particularly, the present invention relates to such an apparatus for releasing fluid exceeding a predetermined maximum level above the fixed crest.

DESCRIPTION OF THE RELATED ART

The use of portable barriers to raise the water level above the elevation of the fixed crest of a permanent dam or to raise the water level in a channelway where water or other liquids flow is well known. Such barriers, however, are not automatically responsive to water pressure and must be manually raised, lowered, or removed in response to changing water conditions. Due to their stationary nature, these barriers are also particularly subject to damage by the presence of debris in the water.

One alternative to the portable dam is the use of water or flood gates to regulate the water line. In its most simplest construction, a flood gate is constructed by inserting pins in holes or sockets that have been drilled or otherwise placed in the fixed crest of a dam. Attached to these steel pins are "boards" which are made of wood, waterproof fabric, or any other material capable of holding or retaining water. The steel pins are designed to tip over (i.e., fail) at a predetermined elevation. This predetermined elevation allows flood flows to pass without unnecessarily damaging upstream shore lines.

After the flood flows have receded to normal flows and elevations, it is necessary to manually remove the damaged pins and any boards that remain on the dam. New or straightened pins and new boards must be reinstalled on the crest of the dam.

This construction is disadvantageous in that it requires frequent maintenance and repair under potentially hazardous conditions. Furthermore, there is often a loss of power generation during the time that the boards are not in their proper place.

Other leveling systems, such as inflatable dams or hydraulically controlled gate boards, have been proposed which are responsive to changing water levels or pressures and which will return to their pre-flood level state. These systems, however, are considerably complex and more expensive than the traditional wood-and-steel pin system. In addition, the presence of debris in the water can puncture the inflatable dam or jam the hinges, springs, or other movable parts in a hydraulically-controlled water gating system.

SUMMARY OF THE INVENTION

It is one intent of this invention to regulate water levels automatically as the water level-induced pressure changes.

It is another intent of this invention to provide a low cost fluid control device whose construction is relatively uncomplicated and which is easy to construct and to maintain.

It is another intent of this invention to construct a fluid control device which is relatively unaffected by the presence of debris in the water.

In accordance with the purposes of the invention, as embodied and broadly described herein, the fluid control apparatus for mounting on a waterway foundation comprises a flexible barrier means for retaining fluid above the foundation, this barrier means having at least an upper portion and bottom portion; cantilever means for supporting the barrier means, the cantilever means operative to assume a fluid-retaining support position in response to fluid levels at or below a predetermined maximum fluid level above the foundation and operative to assume a fluid-releasing support position in response to fluid levels above this predetermined maximum level; means anchoring the cantilever means to the foundation; means attaching the upper portion of the barrier means to the cantilever means; and means for securing the bottom portion of the barrier means adjacent to the foundation to retain fluid above the foundation.

Broadly, the present invention further includes a fluid control apparatus for mounting on a waterway foundation comprising a flexible membrane for retaining fluid above the foundation, the membrane having a top edge and a bottom edge; an arcuate leaf spring means responsive to fluid pressure applied to the membrane to support the membrane in a fluid-retaining position for fluid pressures at or below the tensional force of the leaf spring means and to deflect the membrane to a fluid-passing position for fluid pressures exceeding the tensional force of the leaf spring means, this leaf spring means having first and second ends; means anchoring the first end of the leaf spring means to the foundation; means securing the top edge of the membrane to the second end of the leaf spring means; and means securing the bottom edge of the membrane to the anchor means.

Additional advantages of the present invention will be set forth in part in the description that follows and in part will be obvious from that description or can be learned by practice of the invention. The advantages of the invention can be realized and obtained by the structure and method particularly pointed out in the appended claims.

The accompanying drawings, which are incorporated in and which constitute a part of this specification, illustrate an embodiment of the invention and, together with the description, explain the principles of the invention.

DETAILED DESCRIPTION OF THE INVENTION

Figure 1:
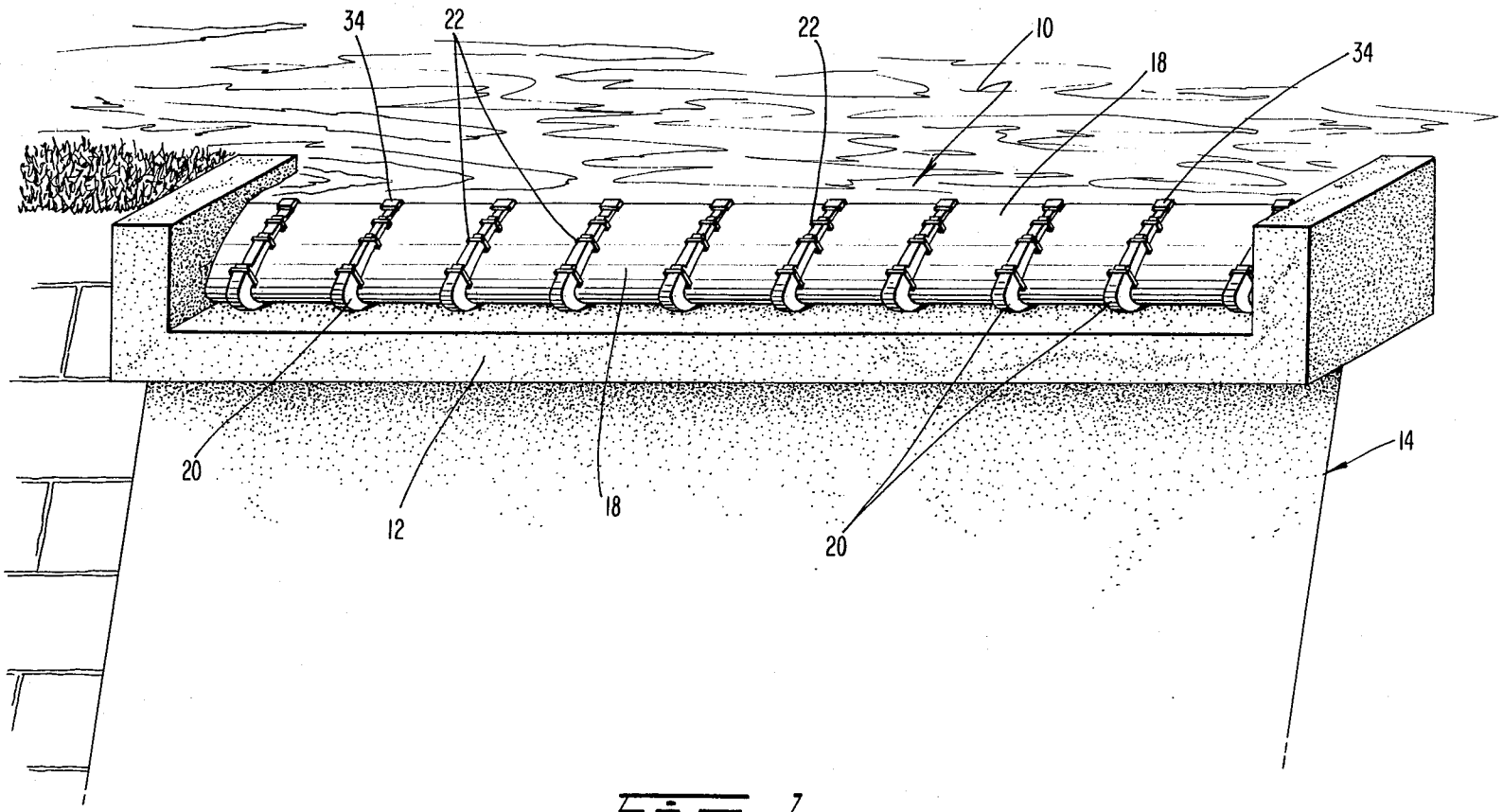
FIG. 1 a general schematic view of a dam with an embodiment of a fluid control apparatus of the present invention shown in the upright position.
Figure 2A:
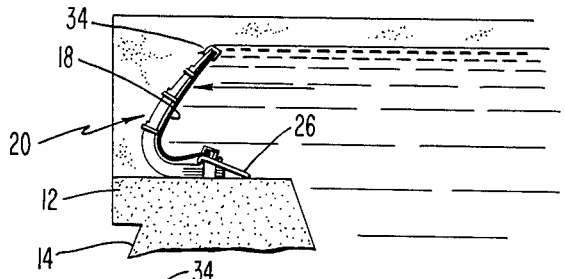
FIGS. 2A–2E show an embodiment of a fluid control apparatus of the present invention deflecting proportionately to rising amounts of fluid.
Figure 2B:
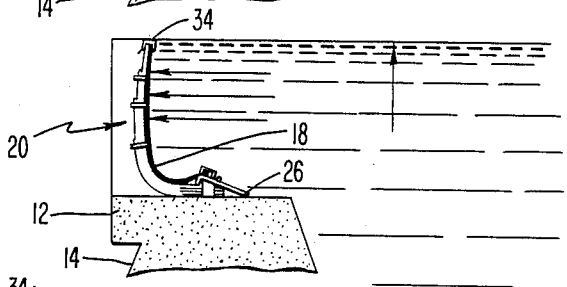
Figure 2C:
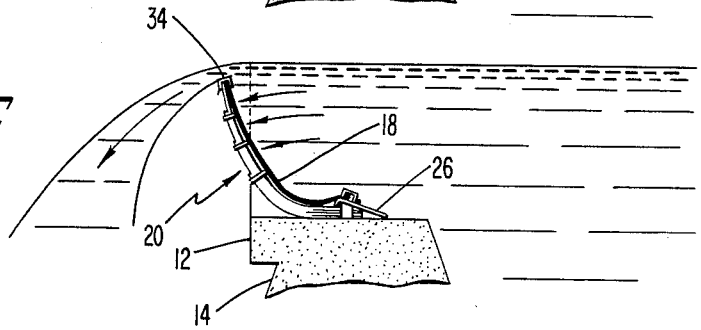
Figure 2D:
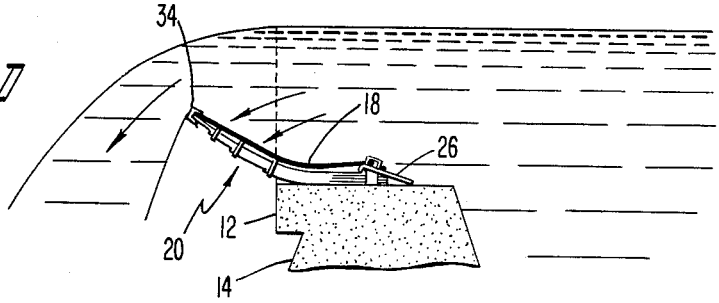
Figure 2E:
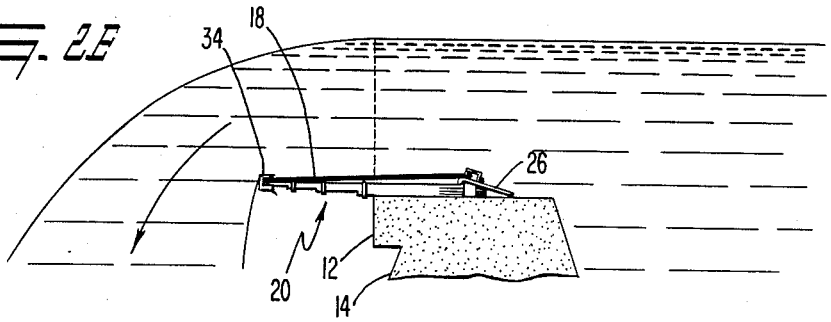

Reference now will be made in detail to presently preferred embodiments of the invention, examples of which are illustrated in the accompanying drawings.

In accordance with the present invention the fluid control apparatus for mounting on a waterway foundation comprises a flexible barrier means and cantilever means for supporting the barrier means. As embodied herein and referring to FIG. 1, a fluid control apparatus 10 is attached to a fixed crest 12 of a conventional dam abutment 14 and comprises a flexible barrier means 18 and cantilever means 20 for supporting the barrier means. Fluid control apparatus 10 is designed and constructed so that if the water level rises above the desired elevation, the device will lower itself in such a manner that allows the excess water to pass over the device, thereby preventing the water level from rising above the level that would occur without the device. The movement of the fluid control apparatus 10 in response to a change in the water level is illustrated in FIG. 2. As the water level recedes, the reduced pressure is overcome by the device, whereupon fluid control apparatus 10 returns to its original fluid retaining support design position, illustrated in greater detail in FIG. 3.

Figure 6:
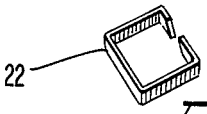
FIG. 6 is a drawing illustrating a clamp that may be used with the leaf spring of the present embodiment of the invention.

In the preferred embodiment, the cantilever means 20 is comprised of a plurality of spaced compound arcuate leaf springs. The individual compound leaf springs 20 must be of sufficient strength to return to their original positions after bending. Preferably, each compound leaf spring 20 is made up of a plurality of tension pin leaves 20*a*, 20*b*, 20*c*, 20*d* and 20*e* which are securely fastened together by clamps 22, as in FIG. 3. Clamp 22 is shown in greater detail in FIG. 6. The number and length of leaf springs 20 to be used will depend upon the height of the fluid to be retained and the angle to which the leaf springs 20 are expected to bend in response to increasing fluid pressures.

Figure 4:
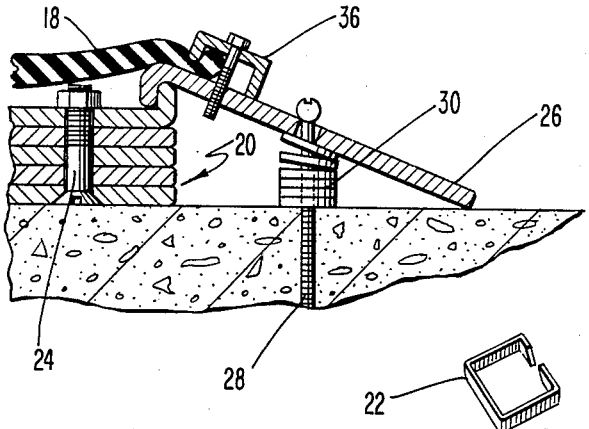
FIG. 4 is a schematic cross sectional view of an embodiment of an anchoring means of the present invention.
Figure 5:
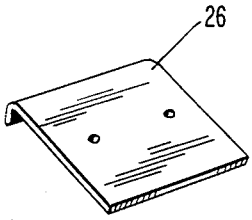
FIG. 5 illustrating an anchor plate that may be used in the present embodiment of the invention.

Leaf springs 20 are firmly attached at one end to insure singular action of leaves 20*a*, 20*b*, 20*c*, 20*d*, and 20*e*. As shown in FIG. 4, one way in which this attachment can be achieved is through the use of flat head bolts 24 and anchor plates 26. Anchor plate 26 is shown in greater detail in FIG. 5. This anchor plate 26 is securely attached to the foundation floor by one or more conventional masonery anchor bolts 28 and spacers 30, and is designed so that the ends of the leaf springs 20 will be restrained between the anchor plate 26 and the foundation.

Figure 3:
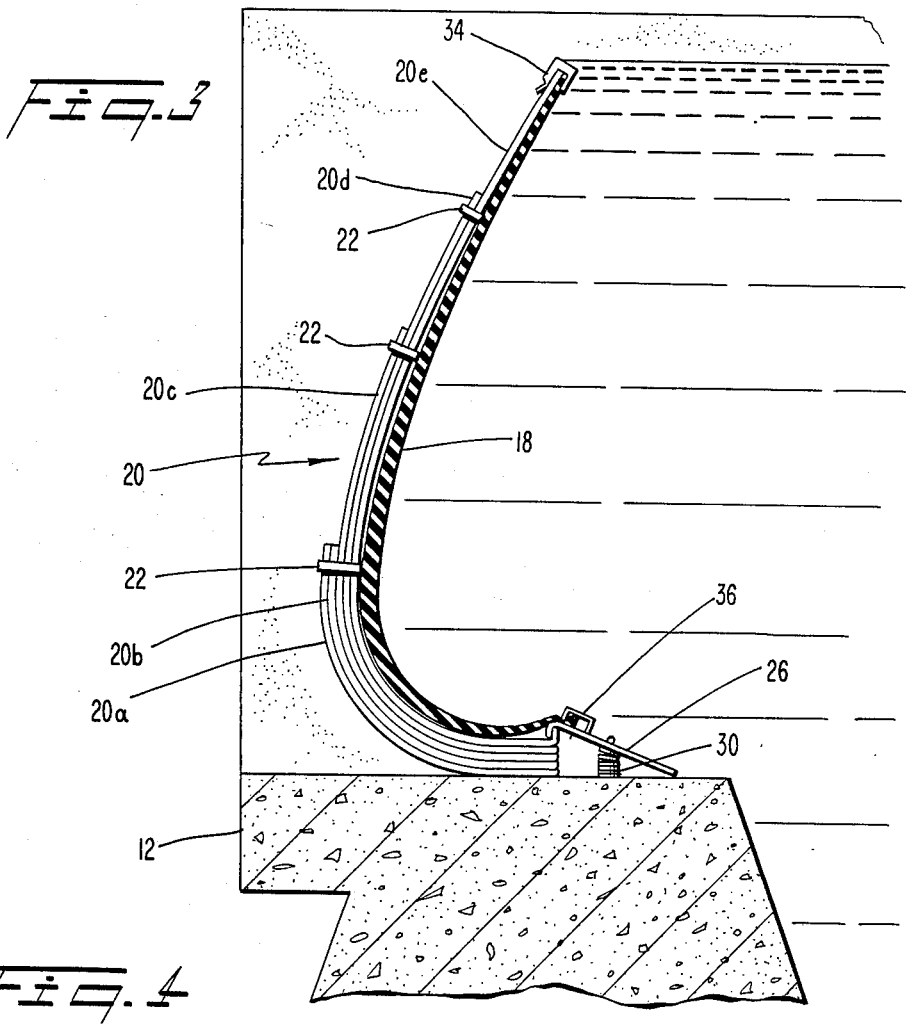
FIG. 3 is a schematic cross sectional view of one embodiment of a fluid control apparatus of the present invention shown in the upright position.

The leaf springs 20 act as ribs to support the flexible barrier means 18. As shown in FIG. 3, flexible barrier means 18 is attached at one end to the upper, unattached portion of leaf springs 20 by a clamp 34. As shown in greater detail in FIG. 4, flexible barrier means 18 is secured adjacent to the foundation by clamp 36. Flexible barrier means 18 is also held in place against leaf springs 20 by the pressure of the water. Flexible barrier means 18 consists of any material which will act as a waterproof flexible membrane such as rubberized fabric or nylon polyvinyl chloride. The flexibility of barrier means 18 allows the leaf springs 20 to "work" and yet act as a barrier to retain the fluid at the design elevation over long periods of time and through many cycles.

As shown in FIG. 1, a plurality of compound leaf springs 20 can be spaced along dam crest 12 to support flexible barrier means 18. The number and spacing of each set of leaf springs 20 will depend upon the width of the channel, the strength of the spring, and the desired water level at which the leaf springs 20 are designed to bend. For given lengths, strengths, and spacings of the leaf springs 20, the fluid control apparatus of the present invention can be deflected substantially horizontal to the foundation floor or to some angle intermediate full extention and the upright position. The closer the spacing of leaf springs 20, the greater the head of water which can be held. Weaker springs spaced more closely together can hold the same amount of head as stronger springs spaced further apart.

In one actual reduction to practice, a fluid control apparatus according to the present invention was constructed to control fluid levels up to 32" across a 24' wide channel. This embodiment employed a series of compound arcuate leaf springs made up of 2" wide by ¼" thick automotive spring steel manufactured by McFarland Spring.

Each leaf spring was composed of five tension pin leaves. The leaf 20*a* shown in FIG. 3 immediately adjacent to the fixed crest foundation was 14" long when fully extended, and leaves 20*b*, 20*c*, 20*d* and 20*e* were 24", 39", 53", and 53" long when fully extended, respectively. The leaves were attached to each other by three stainless steel Bandit clamps spaced 2" down from the bottom of the preceding leaf.

A series of these compound leaf springs 20 were spaced along the channel at 2' intervals, in a manner similar to that shown in FIG. 1. For leaf springs of this construction, two feet was found to be approximately the maximum spacing practical. At eight feet of head or more the spacing may need to be six inches on center. A flexible membrane composed of reinforced vinyl, 30' wide and 60 mils thick, was secured adjacent to the fixed crest foundation and to the unattached upper portions of each compound spring 20.

As the fluid level rises in the channelway, it increases the fluid pressure exerted against the reinforced vinyl membrane which in turn transmits the load to the compound leaf springs. As shown in FIG. 2, when the fluid pressure exerted against the leaf springs exceeds the tensional force of the leaf springs, the leaf springs are deflected proportionately to the amount of water going over the top of the device to release the excess fluid. Typically, fluid is not released until it overtops the device. The amount of overtopping depends upon the particular fluid involved, but has been as much as one to one and one-half feet in actual use. The springs will assume a horizontal position as in FIG. 2E only during extreme high fluid levels. When all the excess fluid has passed, the leaf springs return to their original position, thereby re-erecting the flexible membrane to retain fluid at the design elevation. The springs both deflect proportionately to any additional head of water and return proportionately to the amount of water going over the top of the device.

It is contemplated that simple leaf springs can be used instead of the compound leaf spring construct described above, and that other, non-metallic materials may be used in their fabrication. Furthermore, the flexible membrane need not be clamped to the top of the anchor plate but could, for example, be strung under the anchor plate and attached directly to the foundation floor.

The invention in its broader aspects is, therefore, not limited to the specific details and illustrated examples shown and described. Accordingly, it is intended that the present invention cover such modifications and variations, provided that they fall within the scope of the appended claims and their equivalents.

What I claim is:

1. A fluid control apparatus for mounting on a waterway foundation comprising:

a flexible membrane barrier means for retaining fluid above said foundation, said membrane barrier means having at least an upper portion and bottom portion;

cantilever means for supporting said membrane barrier means, said cantilever means operative to assume a fluid-retaining support position in response to fluid levels at or below a predetermined maximum fluid level above said foundation and operative to assume a fluid-releasing support position in response to fluid levels above said predetermined maximum level;

means anchoring said cantilever means to said foundation;

means attaching the upper portion of said membrane barrier means to said cantilever means; and means for securing the bottom portion of said membrane barrier means adjacent to said foundation to retain fluid above said foundation.

2. The fluid control apparatus of claim 1, wherein said cantilever means includes a plurality of spaced leaf springs.

3. The fluid control apparatus of claim 2, wherein said leaf springs are compound leaf springs.

4. The fluid control apparatus of claim 1, wherein said anchoring means includes an anchor plate bolted to said foundation, said anchor plate having a first end in restraining relationship with said cantilever means and a second end in a contacting relationship with said foundation.

5. The fluid control apparatus of claim 1, wherein said attaching means includes a clamp.

6. The fluid control apparatus of claim 1, wherein said securing means includes a clamp.

7. A fluid control apparatus for mounting on a waterway foundation comprising:

a flexible membrane for retaining fluid above said foundation, said membrane having a top edge and a bottom edge;

an arcuate leaf spring means responsive to fluid pressure applied to said membrane to support said membrane in a fluid-retaining position for fluid pressures at or below the tensional force of said leaf spring means and to deflect said membrane to a fluid-passing position for fluid pressures exceeding the tensional force of said leaf spring means, said leaf spring means having first and second ends;

means anchoring said first end of said leaf spring means to said foundation;

means securing said top edge of said membrane to said second end of said leaf spring means; and means securing said bottom edge of said membrane to said anchor means.

8. The fluid control apparatus of claim 7, wherein said leaf spring means is deflected to a fluid-passing position substantially horizontal to said foundation for fluid pressures exceeding the tensional force of said leaf spring means.

9. The fluid control apparatus of claim 7, wherein said leaf spring means includes a plurality of spaced leaf springs.

10. The fluid control apparatus of claim 9, wherein said leaf spring means are compound leaf springs.

11. A fluid control apparatus for mounting on a waterway foundation comprising:

a flexible barrier means for retaining fluid above said foundation, said barrier means having at least an upper portion and bottom portion;

arcuate cantilever means having upper and lower extreme ends for supporting said barrier means, said cantilever means operative to assume a fluid-retaining support position in response to fluid levels at or below a predetermined maximum fluid level above said foundation and flexibly operative intermediate said extreme upper and lower ends to assume a fluid-releasing support position in response to fluid levels above said predetermined maximum level;

means anchoring said cantilever means to said foundation;

means attaching the upper portion of said barrier means to said cantilever means; and means for securing the bottom portion of said barrier means adjacent to said foundation to retain fluid above said foundation.

* * * * *